US005720076A

United States Patent [19]

Clark

[11] Patent Number: 5,720,076

[45] Date of Patent: Feb. 24, 1998

[54] VACUUM CLEANER

[75] Inventor: David Michael Clark, Leeds, United Kingdom

[73] Assignee: Goblin Limited, West Yorkshire, England

[21] Appl. No.: 641,277

[22] Filed: Apr. 30, 1996

[30] Foreign Application Priority Data

Nov. 15, 1995 [GB] United Kingdom ..... 9523417

[51] Int. Cl.[6] ..... A47L 9/00

[52] U.S. Cl. ..... 15/339; 15/327.2; 15/327.7

[58] Field of Search ..... 15/327.1, 327.2, 15/327.7, 339

[56] References Cited

U.S. PATENT DOCUMENTS

| | | | |
|---|---|---|---|
| 3,015,123 | 1/1962 | Descarries . | |
| 3,104,112 | 9/1963 | Crail | 280/5.2 |
| 3,820,808 | 6/1974 | Brunning et al. | 15/327.1 X |
| 3,881,535 | 5/1975 | Du Bois et al. | 15/327.2 |
| 4,357,177 | 11/1982 | Knox | 15/327.2 X |

FOREIGN PATENT DOCUMENTS

| | | | |
|---|---|---|---|
| 658328 | 10/1951 | United Kingdom | 15/327.2 |
| 771325 | 3/1957 | United Kingdom . | |
| 1441605 | 7/1976 | United Kingdom . | |
| 1460359 | 1/1977 | United Kingdom . | |

*Primary Examiner*—Chris K. Moore

*Attorney, Agent, or Firm*—Marshall, O'Toole, Gerstein, Murray & Borun

[57] ABSTRACT

A vacuum cleaner has wheels which can rotate in one direction only, when the body of the cleaner is inclined to the horizontal, such as when the cleaner is disposed on a flight of stairs. A prop provides alternative or additional support by engaging the stair surface. The invention reduces the possibility of the cleaner rolling off the stair tread and falling down the stairs.

18 Claims, 1 Drawing Sheet

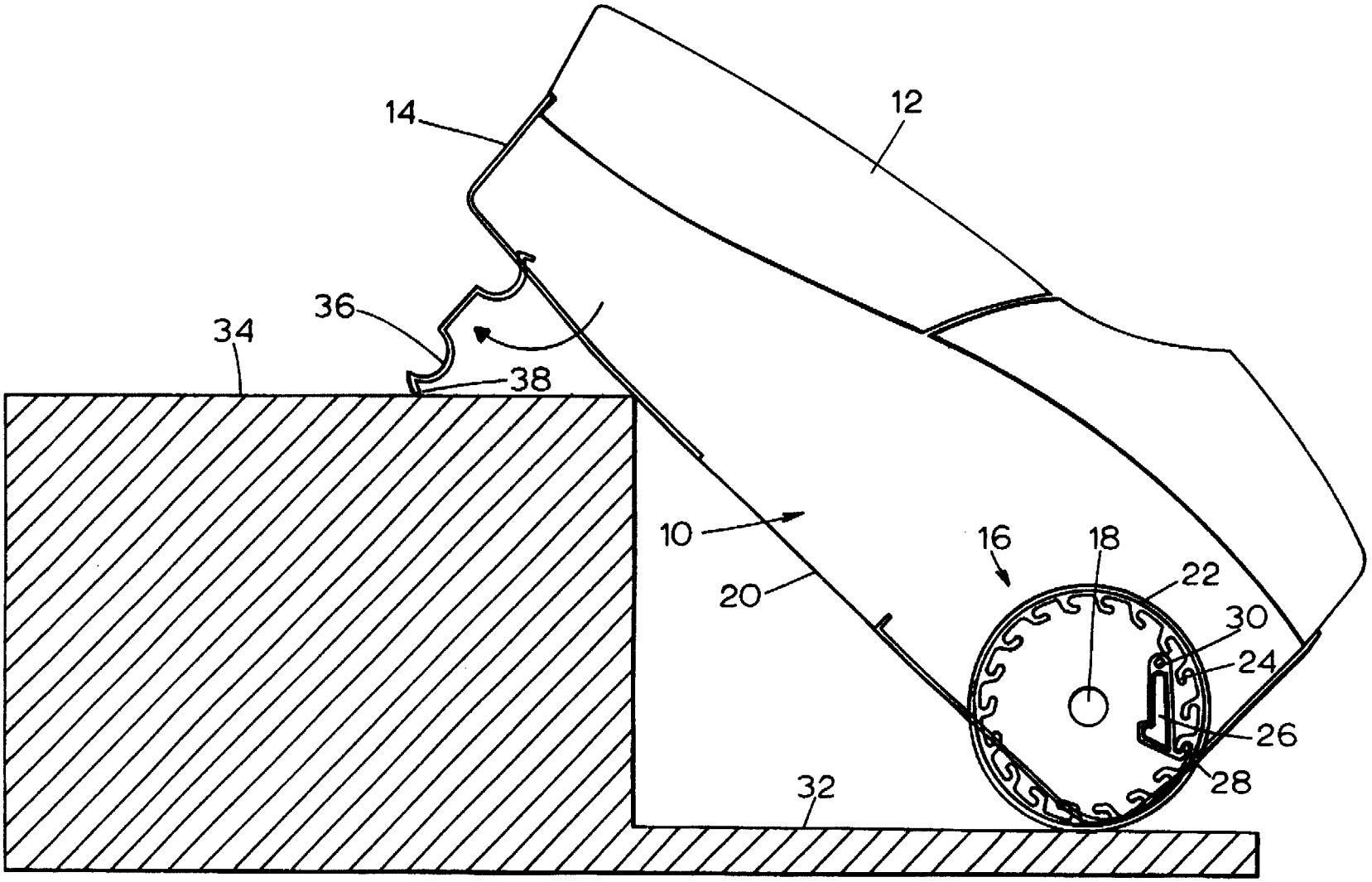
12
14
36
34
38
10
20
32
16
18
22
30
24
26
28

VACUUM CLEANER

This invention relates to vacuum cleaners for domestic or industrial use, and to other domestic appliances which may encounter the same problem as discussed below.

Vacuum cleaners are often used for cleaning stairs, for which purpose the cleaner has to be balanced precariously on the stairs if the flight of stairs is too long to leave the cleaner at the top or bottom. When so balanced the cleaner is vulnerable to being tipped or dislodged by forces arising from the stair-cleaning procedure and communicated through the suction hose.

The preferred embodiment of the present invention is directed to alleviating this problem whilst still permitting the cleaner to be moved easily across the floor, eg. by being pulled by the suction tube.

According to one aspect of the invention, there is provided a vacuum cleaner or other domestic appliance comprising means for supporting the appliance on a stair, the supporting means permitting movement of the appliance in one direction but impeding movement thereof in the opposite direction.

Preferably, the support means impede movement in the opposite direction only when the body of the appliance has been inclined at more than a predetermined angle to the horizontal.

The appliance may comprise a suction hose fitting, the one direction being such that the appliance may be pulled along by a suction hose attached to the fitting.

Thus, when the cleaner is balanced on stairs it can be pulled up the stairs, eg. by the suction hose, but the support means will tend to prevent it rolling or sliding backwards off the stair tread and falling down the stairs.

The support means may comprise at least one wheel having means permitting rotation thereof in one sense only.

The permitting means may comprise a ratchet and pawl mechanism.

The ratchet may comprise a ring of detents provided around the rotation axis of the wheel.

The pawl may be mounted so as to move into engagement with the ratchet upon said inclination of the body portion.

The pawl may be pivotally mounted about an axis spaced from its centre of gravity.

Preferably, the ratchet is disposed around the inside of a rim of the wheel.

The pawl may be mounted within the wheel, and/or may be pivotally mounted on the body of the appliance.

The support means may alternatively or in addition comprise a prop for supporting the appliance in said inclined position.

The prop means may comprise a prop extendable from the appliance at a part thereof spaced longitudinally of the appliance from the said wheel.

The prop may be foldably disposed on the underside of the appliance.

The prop may comprise means for engaging a surface from which the appliance is propped.

The invention now will be described merely by way of example with reference to the accompanying drawing.

In the drawing, a cylinder-type vacuum cleaner has a body 10 (not necessarily cylindrical) containing (as known per se) a motor-driven suction fan and a dust bag. A detachable lid 12 gives access to the dust bag. An end face 14 has a bayonet fitting (not shown in the drawing) to which a conventional suction hose is attachable. Near the other end of the body are a pair of wheels (only one shown at 16) disposed on an axle 18 which support the rear of the cleaner body so that it may be dragged around the floor by the suction hose with its underside 20 generally parallel to the floor.

The wheels are mouldings or pressings from thin sheet material and have relatively wide rims 22 supported on a relatively thin section web. The rims may be provided with rubber tyres or other high-friction surface. Around the inside of the rim 22 of at least one and preferably both of the wheels is a rack or ratchet consisting of hook-shaped teeth 24. A pawl 26 having a conforming hook-shaped end 28 is pivotally mounted at one end on a pin 30 set into the body 10. The centre of gravity of the pawl is spaced from the pivot 30 and thus the pawl hangs approximately vertically from the pivot. The pivot is spaced from the axle 18 so that when the cleaner body is substantially horizontal the pawl hangs clear of the ratchet 24 and the wheel 16 can rotate both clockwise and anti-clockwise. When the body of the cleaner is inclined through a substantial angle, as shown in the drawing, the angular disposition of the pivot 30 relative to the axle 18 is changed, and the pawl 26 engages the ratchet 24.

The cleaner is shown in the drawing supported by its wheels on the tread of one stair 32, and with its other end supported from the upwardly adjacent tread 34. The ratchet 24 and pawl 26 are configured such that trailing disengagement of one from the other permits anti-clockwise rotation of the wheel 16, but clockwise rotation of the wheel is baulked by positive engagement of the pawl with the ratchet. The other wheel 16 has a similar ratchet and pawl, which are handed (chiral) compared to those shown in the drawing, so that anti-clockwise rotation thereof is baulked. Thus the cleaner body can be pulled up the stairs, eg. by the suction hose, but the wheels are prevented from rotating in the other direction, to reduce the tendency for the cleaner to slip off the tread and down the stairs.

In an alternative construction, only one wheel may be provided with a ratchet and pawl, in which case it is preferable that the wheels are fast on the axle 18 so that they cannot rotate relative to each other. Of course the axle then must be free to rotate in bearings provided in the body 10. A ratchet and pawl on one only of a relatively rotatable pair of wheels can still provide protection against the cleaner rolling off the tread, but restraining rotation of both wheels is preferred.

The end of the cleaner body remote from the wheels 16 has a prop 36 foldably connected to the underside 18 of the body. The prop is pivoted downwards from the body when the cleaner is to be used on stairs, and as shown serves to support the cleaner in its inclined position. The free end 38 of the prop has a relatively sharp edge which engages the stair tread (especially if it is carpeted) to resist further any tendency for the cleaner to slip backwards down the stairs. Alternatively or in addition it may have a rubber or other frictional coating or sheath to improve grip on smooth surfaces such as uncarpeted stairs. Thus the prop alone provides some protection against rearward movement of the cleaner body, even if unidirectional restraint of the wheels is not provided.

Each feature disclosed in this specification (which term includes the claims) and/or shown in the drawings may be incorporated in the invention independently of other disclosed and/or illustrated features.

The appended abstract as filed herewith is included in the specification by reference.

I claim:

1. An apparatus for use in a vacuum cleaner, comprising:

means for supporting the vacuum cleaner on a stair; and a ratchet and a pawl rendered operative by inclination of the vacuum cleaner relative to a horizontal plane for permitting movement of the vacuum cleaner in a first direction but which impedes movement in a second direction opposite the first direction.

2. The apparatus of claim 1, wherein the pawl is mounted so as to move into engagement with the ratchet upon inclination of the vacuum cleaner.

3. The apparatus of claim 2, wherein the pawl is pivotally mounted about an axis spaced from a center of gravity thereof.

4. The of claim 2, wherein the pawl is pivotally mounted about an axis spaced from a center of gravity thereof.

5. The of claim 4, wherein the ratchet comprises a ring of detents provided around a rotational axis of the wheel.

6. The of claim 5, wherein the ring of detents is disposed around an inside of a rim of the wheel.

7. The apparatus of claim 6, wherein the pawl is mounted within the wheel.

8. The apparatus of claim 7, wherein the pawl is pivotally mounted on a body of the vacuum cleaner.

9. The apparatus of claim 1, wherein the support means comprises at least one wheel.

10. The apparatus of claim 9, wherein the ratchet comprises a ring of detents provided around a rotational axis of the wheel.

11. The apparatus of claim 10, wherein the ratchet is disposed around an inside of a rim of the wheel.

12. The apparatus of claim 10, wherein the pawl is mounted within the wheel.

13. The apparatus of claim 11, wherein the pawl is pivotally mounted on a body the vacuum cleaner.

14. An apparatus for use in a vacuum cleaner, comprising:

means for supporting the vacuum cleaner on a stair including a prop which supports the vacuum cleaner in a position inclined with respect to a horizontal plane and which frictionally engages the stair; and a mechanism operative when the vacuum cleaner is inclined relative to the horizontal plane for permitting movement of the vacuum cleaner in a first direction but which impedes movement in a second direction opposite the first direction.

15. The of claim 14, wherein the supporting means comprises a wheel and wherein the prop is extendable from the vacuum cleaner at a part thereof spaced longitudinally from the wheel.

16. The of claim 15, wherein the prop is foldably disposed on an underside of the vacuum cleaner.

17. The of claim 16, wherein the mechanism includes a ratchet and a pawl engageable with the ratchet.

18. The of claim 17, wherein the pawl is mounted so as to move into engagement with the ratchet upon inclination of the vacuum cleaner.

* * * * *